US005597014A

United States Patent [19]

Vick

[11] Patent Number: 5,597,014

[45] Date of Patent: Jan. 28, 1997

[54] HIGH-FLOW DIRECT-DRIVE ROTARY SERVOVALVE

[75] Inventor: Ralph L. Vick, Granada Hills, Calif.

[73] Assignee: Moog Inc., East Aurora, N.Y.

[21] Appl. No.: 555,574

[22] Filed: Nov. 8, 1995

Related U.S. Application Data

[63] Continuation-in-part of Ser. No. 447,113, May 22, 1995, abandoned, which is a continuation of Ser. No. 220,803, Mar. 31, 1994, abandoned.

[51] Int. Cl.[6] ..... F15B 13/04

[52] U.S. Cl. ..... 137/625.23; 251/283

[58] Field of Search ..... 137/625.22, 625.23; 251/283

[56] References Cited

U.S. PATENT DOCUMENTS 4,479,512 10/1984 Ohrendorf et al. ..... 137/625.23 X
4,794,845 1/1989 Vick ..... 137/625.23 X

*Primary Examiner*—Gerald A. Michalsky
*Attorney, Agent, or Firm*—Phillips, Lytle, Hitchcock, Blaine & Huber

[57] ABSTRACT

A rotary valve (10) is adapted to be associated with a fluid source (P) and a fluid return (R), and is adapted to control the flows of fluid (via control ports $C_1$ and $C_2$) with respect to the opposed chambers of a fluid-powered load. The valve has a body (11) provided with an elongated bore (12). The body has a plurality of passageways (23, 24, 25, 26) communicating spaced locations along the bore with the source, return and load control ports, respectively. A spool member (28) is rotatably mounted in the bore. The spool member has a passage adapted to cooperate with a body passageway so as to define at least one flow-metering port therebetween. The area of this flow-metering port or orifice (34) is a function of the angular displacement of the spool member relative to the body from a null position. The improvement comprises each of the upstream approach walls (32, 35) adjacent the orifice being relieved at an angle (β) of at least 21° with respect to a radial plane so as to cause the flow through the orifice, whether directed inwardly or outwardly, to be substantially radial, thereby to eliminate tangential Bernoulli reaction forces acting on the spool member.

12 Claims, 3 Drawing Sheets

HIGH-FLOW DIRECT-DRIVE ROTARY SERVOVALVE

This is a continuation-in-part of U.S. patent application Ser. No. 08/447,113, filed May 22, 1995, now abandoned, which was a continuation of U.S. patent application Ser. No. 08/220,803, filed Mar. 31, 1994, now abandoned.

TECHNICAL FIELD

This invention relates generally to the field of rotary valves having a spool member rotatably mounted within a body, and, more particularly, to an improved four-way rotary valve in which the Bernoulli flow reaction forces that act on the spool member, and that normally tend to close the metering orifices, are substantially eliminated.

BACKGROUND ART

A rotary electrohydraulic servovalve typically has an output stage having a multiple-lobed spool member rotatably mounted within a body to control the flows of pressurized fluid through variable-area metering ports or orifices to and from the opposed chambers of a fluid-powered load. Preferably, the metering ports are rectangularly-shaped and the cooperating lobe edges are straight and parallel to the axis of spool rotation so that the orifices will also be rectangular, thereby causing the valve to have a constant flow gain (i.e., so that flow through the valve will be substantially proportional to angular displacement of the spool member from a null position).

It is well known that the flow jet through such square-edged metering orifices will inherently be at an angle of about 69° to the circumferential plane of the metering port opening. This flow angle will create a reaction force on the spool having both tangential and radial components. The radial component will not have any appreciable effect on the spool member. However, the tangential component will cause an orifice-reducing reaction force. These flow reaction forces are sometimes called "Bernoulli" forces, and are illustrated and described in Blackburn et al., *Fluid Power Control*, The M.I.T. Press (1960) [§10.3 et seq.].

While the presence of such Bernoulli forces has been known, their existence has become particularly problematic in direct-drive rotary servovalves in which a spool member is rotated directly by a limited-force torque motor. Such flow forces may be reduced by application of the same techniques which have been employed on linear spool valves. (See, e.g., Blackburn et al., supra, and R. N. Clark, "Compensation of Steady-State Flow Forces in Spool-Type Hydraulic Valves", A.S.M.E. Paper No. 56-A-121 (1957).) This paper discusses the existence of such flow forces, the trend toward smaller and smaller valve drivers, and illustrates three possible ways of compensating the effect of such forces. These compensation schemes include: (1) the provision of radial-hole orifices, (2) the provision of "recirculation lands" downstream of the flow-metering orifices, and (3) pressure-drop compensation. Such downstream "recirculation lands" are also shown in Blackburn et al., supra, at section 10.321, although Blackburn appears to denominate them as "negative-force ports" rather than "recirculation lands".

Ohrendorf et al. (U.S. Pat. No. 4,479,5 12) discloses a type of high-flow combined rotary and linear servovalve that recognizes the existence of Bernoulli-type flow forces that exert orifice-closing reaction forces on the spool member, and suggests applying the methods discussed by Clark (see, e.g., col. 2, line 10 et seq. and col. 6, line 43 et seq.).

However, Ohrendorf does not appear to eliminate substantially all of the flow forces acting on the spool member.

Applicant's earlier U.S. Pat. No. 4,794,845 discloses a type of high-flow direct-drive rotary servovalve having a spool member rotatably mounted within a sleeve-like body. While this patent posited that careful control of the angle of entry of the flow through the metering ports (i.e., between the pressure source and the load only) established by certain slots could minimize or nearly eliminate the Bernoulli flow forces (see, e.g., col. 5, line 66 et seq.), the referenced slots or surfaces are, in fact, located downstream of the orifices in question and thus do not affect the flow entry angle. It has since been determined that the observed reduction of flow forces was due to the fortuitous configuration of the upstream spool passage wall 32, as shown in FIG. 2 and described below. The operative fluid flow phenomenon has been observed in linear displacement servovalves which were modified to reduce the effect of viscosity on the metered flow by relieving the surfaces immediately upstream of metering orifices, causing them to appear as "sharp-edged" rather than as "short tubes".

While these references do recognize the fact that Bernoulli-type flow forces act on the spool in such a way as to tend to close the flow-metering orifice, they do not appear to have contemplated the desirability of preventing such forces from occurring in the first instance. Because of the continuing tendency toward smaller and more-compact valve drivers, it is desirable to substantially eliminate such flow forces, rather than to overpower them or compensate for their existence.

DISCLOSURE OF THE INVENTION

With parenthetical reference to the corresponding parts, portions and surfaces of the disclosed embodiment, merely for purposes of illustration and not by way of limitation, the present invention provides, in one aspect, a unique improvement in a rotary valve (10) that is adapted to be associated with a pressurized fluid source (P) and a lower pressure fluid return (R), and is adapted to control the flow of fluid through at least one variable-area metering port ($C_1$ or $C_2$) with respect to the opposed chambers of a fluid-powered load. The valve has a body (11) provided with an elongated bore (12), and has at least one passageway (23) communicating a location along the bore with one of the source (P), the return (R), and control ports ($C_1$, $C_2$). The valve also has a spool member (28) rotatably mounted within the bore. The spool member has at least one passage (30) adapted to cooperate with the body passageway (23) to uncover at least one metering port or orifice (34) therebetween. The areas of these metering ports are a function of the angular displacement of the spool member relative to the body from a null position. In this form, the improvement broadly subtends in the cooperative body passageway and spool passage being so configured and arranged as to substantially prevent the application of orifice-closing tangential flow reaction forces on the spool member, regardless of whether the flow through the orifice is inward or outward. In the presently-preferred form, the proximate upstream approach walls of the body and spool member are severally relieved by an angle $\beta$ of about 21° or more so that the flow through the orifice will be substantially radial and will not have any tangential component.

Accordingly, the general object of the invention is to provide an improved rotary valve that is capable of direct operation with a low-torque driver.

Another object is to provide an improved direct-drive rotary valve in which the Bernoulli forces that create reaction forces tending to close the orifices are substantially reduced, if not eliminated, in a manner independent of the direction of flow (i.e., inwardly or outwardly) through the orifice.

These and other objects and advantages will become apparent from the foregoing and ongoing written specification, the drawings, and the appended claims.

DESCRIPTION OF THE PREFERRED EMBODIMENTS

Figure 1:
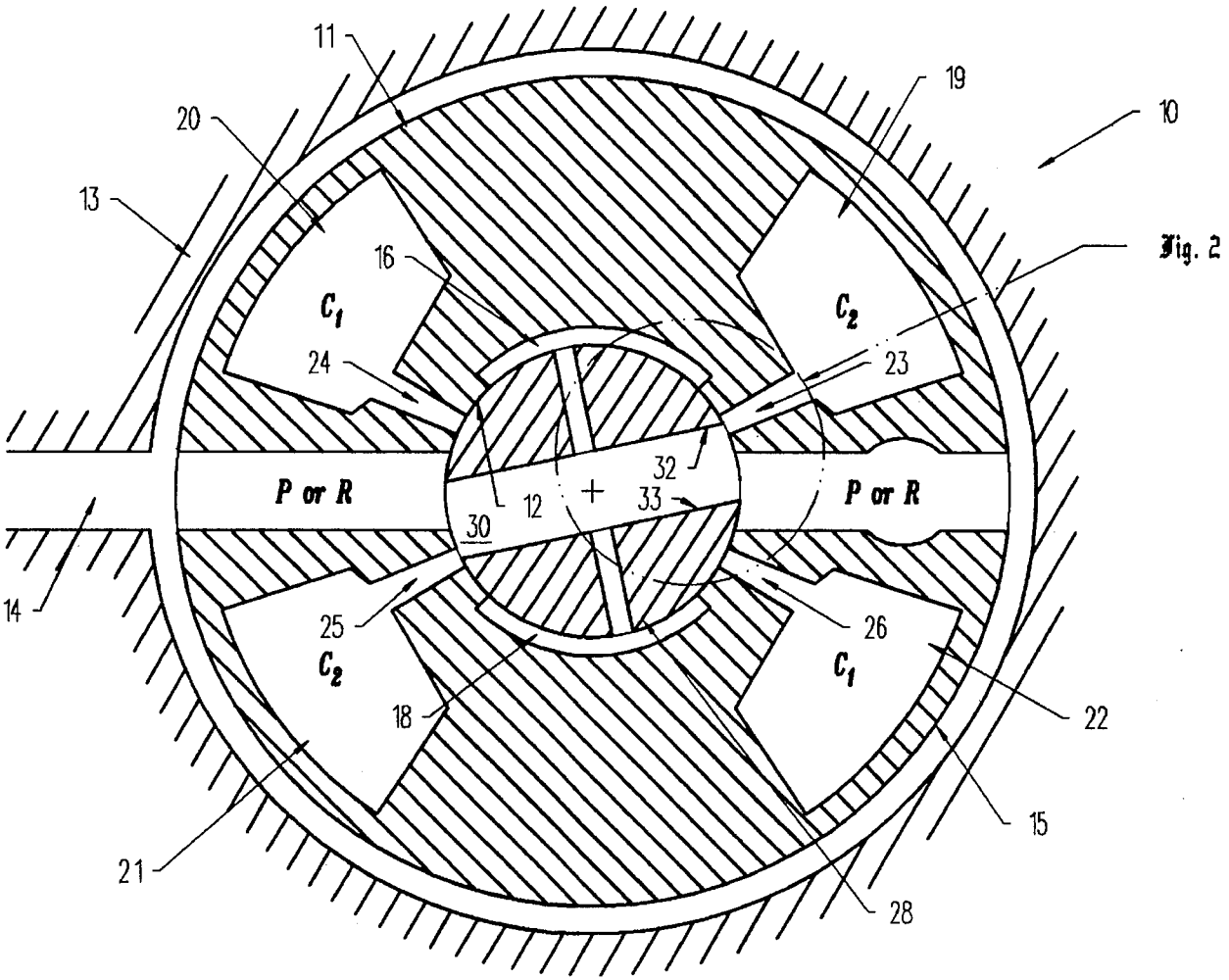
Fig. 1 (PRIOR ART)
FIG. 1 is a schematic fragmentary transverse vertical sectional view through a prior art rotary valve, this view being substantially similar to FIG. 11 of U.S. Pat. No. 4,794,845, but showing the spool member as having been rotated so as to partially open the metering ports.

At the outset, it should be clearly understood that like reference numerals are intended to identify the same structural elements, portions or surfaces consistently throughout the several drawings figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally ", "rightwardly", "upwardly ", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Turning now to the drawings, FIG. 1 schematically depicts a prior art rotary valve, generally indicated at 10, having a body 11 provided with an elongated cylindrical bore 12. In FIG. 1, the body is shown as including a sleeve-like member 11 operatively mounted within an outer body part 13. A radial space is provided between body parts 11, 13, and this space communicates via conduit 14 with either a pressure source (P) or return (R), depending on the axial location along the spool. Thus, the body may be of either unitary or assembled construction, as desired. For the purposes of this description, the body will be described as being in the form of a simple tubular sleeve, having an inwardly-facing cylindrical surface forming bore 12, and an outwardly-facing cylindrical surface 15.

The body is also shown as having four chambers that communicate with the bore via individual rectangular passageways. These four chambers are indicated at 19, 20, 21 and 22, respectively, and the associated passageways are indicated at 23, 24, 25 and 26, respectively. In the form shown, chambers 20 and 22 communicate with one outlet port (not shown) at a control pressure $C_1$, and chambers 19 and 21 communicate with another outlet port (not shown) at a control pressure $C_2$. These two outlet ports are connected to opposite sides of a fluid-powered load (not shown) in the conventional manner (See, e.g., U.S. Pats. No. 5,240,041 and 4,827,981, the aggregate disclosures of which are hereby incorporated by reference, with respect to the manner by which the output stage may be operatively connected to a fluid-powered load). Each passageway has the appearance of a truncated wedge with two opposite planar parallel walls and two opposite planar converging walls. The illustrated walls defining the rectangular body passageways 23, 24, 25 and 26, are severally shown as being radial, and hence are convergent.

Figure 2:
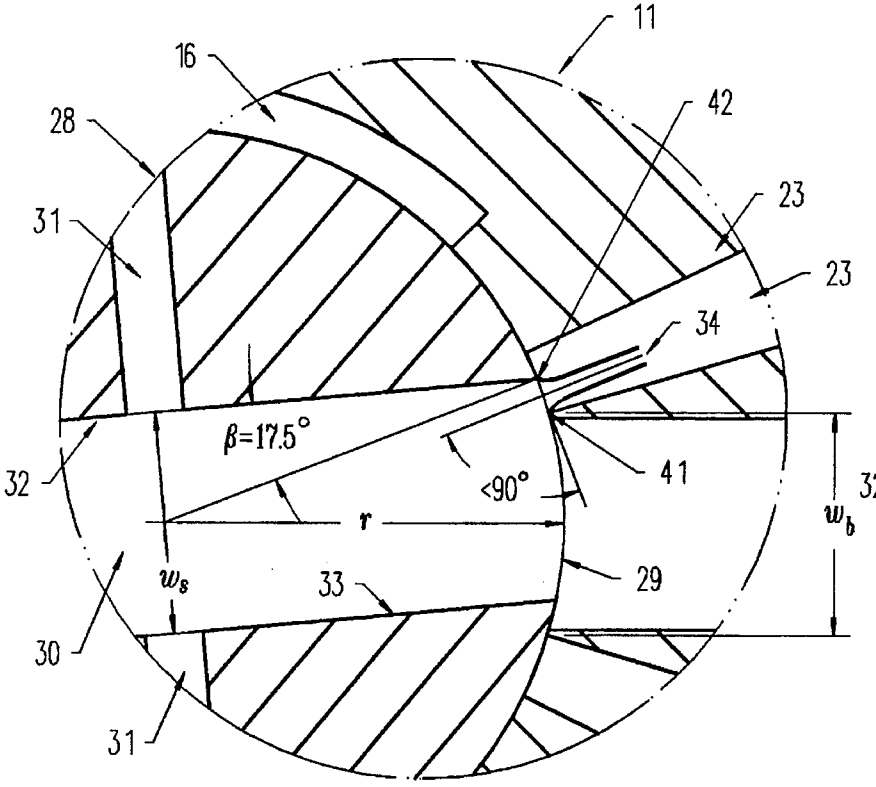
Fig. 2 (PRIOR ART)
FIG. 2 is an enlarged view of the portion of the structure within the indicated area of FIG. 1, and illustrates outward flow through a metering-port orifice.

A spool member, generally indicated at 28, is shown as being operatively arranged within body bore 12 for rotatable movement relative thereto. More particularly, spool member 28 is shown as having an outer cylindrical surface 29 arranged in closely-spaced facing relation to body bore 12. The spool member has a large diametrically-extending through-passage, indicated at 30, extending generally from the 9 o'clock position to the 3 o'clock position. Passage 30 has a substantially-rectangular transverse cross-section. Hence, walls 32, 33 are planar and parallel, and will form rectangular metering ports as either opposed passage pair, 23, 25 or 24, 26, is uncovered by rotation of the spool. As best shown in FIGS. 2–5, spool member passage 30 is shown as having a nominal transverse dimension of w, which will be made equal by design to the spacing $w_b$ between the passages 23 and 26, so that the spool may be rotated to a null position at which both of the metering ports are just closed. As the spool 28 is rotated in a counterclockwise direction, as shown in FIG. 2, a metering port orifice 34 will be opened between spool passage 30 and body passage 23, defined by parallel edges 41 and 42. If the passage wall 32 just upstream of edge 42 had been radially oriented (i.e., perpendicular to the plane of the orifice), the flow jet into passage 23 would have been at an angle of approximately 69° to the plane of the orifice and would thus have produced a flow reaction force having a tangential component tending to rotate the spool to its null position. However, in Applicant's prior art valve (i.e., as shown in U.S. Pat. No. 4,794,845), for convenience in fabrication the wall 32 was formed parallel to the centerline of passage 30, thereby relieving wall 32 from a radial plane through edge 42 by an angle β. While the angle was not deemed critical in the prior art disclosure, and therefore not specified, the figures show the angle to be approximately 17.5°. This would have resulted in causing the flow jet into passage 23 to be at an angle greater than 69°, but still less than 90°, thereby reducing (but not eliminating) the tangential component of the flow reaction force. However, it can be shown that, if the relief angle is made 21° or greater, the flow jet into passage 23 will be perpendicular to the plane of the orifice and the tangential component of the flow reaction force will be essentially eliminated.

Figure 3:
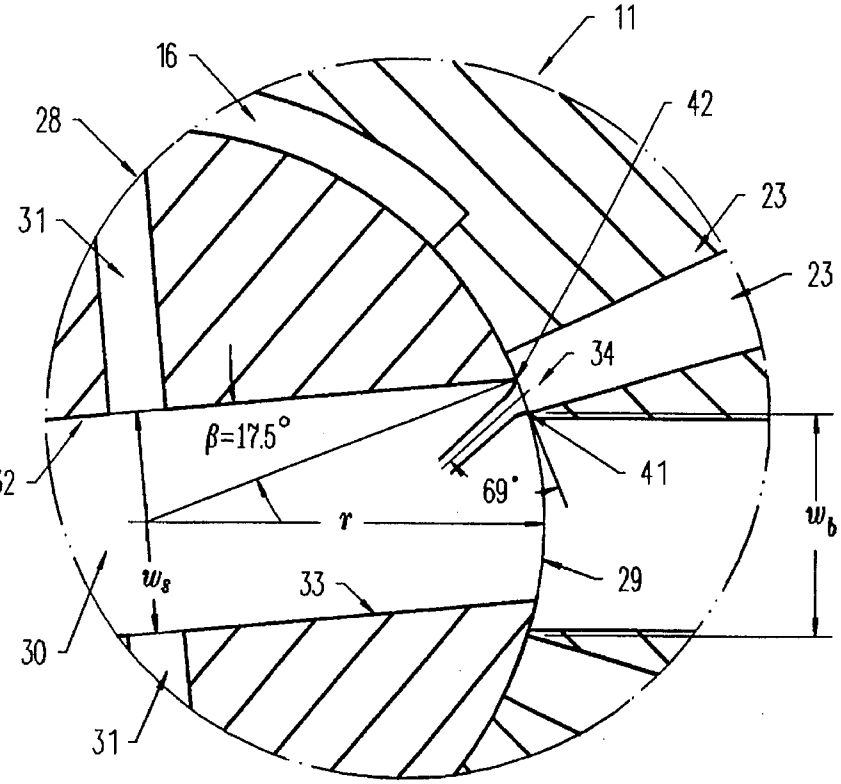
Fig. 3 (PRIOR ART)
FIG. 3 is an enlarged view of the portion of the structure shown in FIG. 2, but illustrates inward flow through the metering-port orifice.

FIG. 3 shows the same prior art valve configuration as FIG. 2 but with the passage 14 connected to return pressure so that the flow through the metering port orifice is radially inward. In this case, the flow jet through the metering port orifice into spool passage 30 will be at an angle of 69° to the orifice plane, and the tangential component of the flow reaction force will be a maximum.

Figure 5:
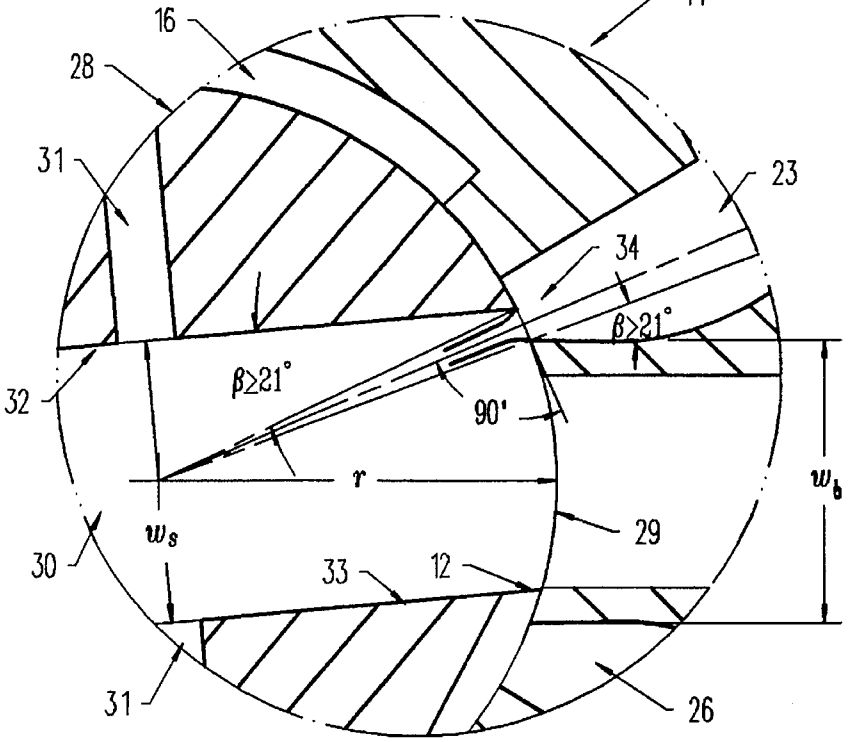
FIG. 5 is an enlarged view, generally similar to FIG. 3, showing inward flow through the metering port orifice, but showing the body approach wall upstream of the metering orifice edge as having been specially shaped to make the relief angle at least 21°.
Figure 4:
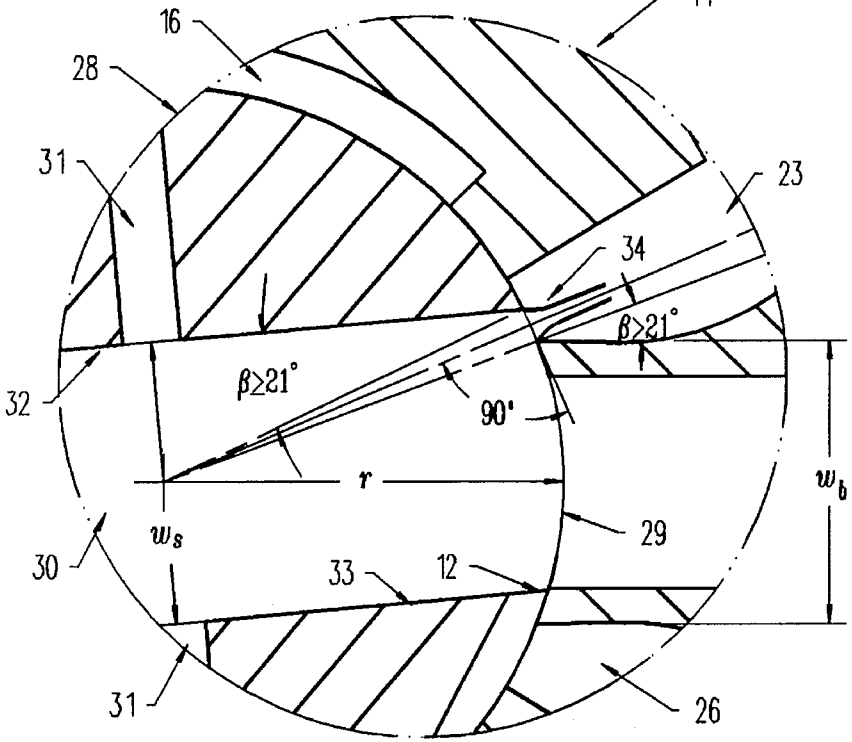
FIG. 4 is an enlarged view, generally similar to FIG. 2, showing outward flow through the metering port orifice of the improved valve, except that the relief angle of the approach wall upstream of the metering port orifice edge is made at least 21°.

FIGS. 4 and 5 illustrate the improvements to Applicant's prior art valve to implement the present invention, which essentially eliminates tangential flow reaction forces on the valve spool. In FIG. 4, which is generally similar to FIG. 2 in showing outward flow, the separation $w_b$ of the metering edges 41 and 42, associated with the body passages 23 and 26 respectively, and the matching width $w_s$ of the spool passage 30, have been increased so as to make the relief angle β of wall 32 at least 21°. This will cause the flow jet into passage 23 to be perpendicular to the plane of the orifice and consequently the tangential component of the flow reaction force to be essentially eliminated.

FIG. 5, which is generally similar to FIG. 3 in showing inward flow, illustrates how the proximate approach wall 35 upstream of the metering port edge 42 may be shaped so as to create a relief angle β of at least 21°. This will cause the flow jet into spool passage 30 to be perpendicular to the plane of the orifice and consequently the tangential component of the flow reaction force to be essentially eliminated.

Thus, by configuring a rotary servovalve so that the passage walls upstream of the orifice edges of the valve metering ports are each relieved by at least 21° from a radial plane through each orifice edge, the associated flow jets are caused to be substantially radial. Consequently, the tangential components of the Bernoulli flow reaction forces are eliminated, permitting direct actuation of the valve spool with a smaller drive motor.

The present invention contemplates that many changes and modifications may be made. For example, the salient feature of the invention is to relieve the proximate approach wall of an orifice by an angle of 21° or more so as to substantially eliminate tangential force components, regardless of the direction of flow. Given this parameter, the materials of construction are not deemed critical.

Therefore, while the presently-preferred form of the improved valve has been shown and described, persons skilled in this art will readily appreciate that various additional changes and modifications may be made without departing from the spirit of the invention, as defined and differentiated in the following claims.

What is claimed is:

1. In a rotary valve adapted to be associated with a fluid source and a fluid return, and adapted to control the flows of fluid through variable-area metering ports with respect to the opposed chambers of a fluid-powered load, said valve having a body provided with an elongated bore, said body having at least one passageway communicating at a location along said bore with said one of said source, return and load, said valve also having a spool member rotatably mounted in said bore, said spool member having a passage adapted to cooperate with said body passageway so as to selectively uncover a metering port therebetween, the orifice area of said metering port being a function of the angular position of said spool member relative to said body, wherein the improvement comprises:

said cooperative body passageway and spool passage being so configured and arranged so as to cause the flow through said metering port to be oriented such that the application of tangential reaction forces attributable to said flow to said spool member is eliminated, and wherein a wall of the passage or passageway located upstream of said orifice terminates in an edge of said metering port which is arranged in a plane containing the axis of said spool and said wall is relieved from said plane by art angle of at least 21° such that the flow through said metering port is radial.

2. The improvement as set forth in claim 1 wherein said body includes a sleeve member surrounding said spool member and extending said body passage to cooperate with said spool passageway.

3. The improvement as set forth in claim 1 wherein said body passageway is substantially rectangular at the intersection of said bore.

4. The improvement as set forth in claim 1 wherein said spool member passage is substantially rectangular in the vicinity of said bore.

5. In a rotary valve adapted to be associated with a fluid source and a fluid return, and adapted to control the flows of fluid through variable-area metering ports with respect to the opposed chambers of a fluid-powered load, said valve having a body provided with an elongated bore, said body having a passageway communicating at a location along said bore, said valve also having an elongated spool member rotatably mounted in said bore, said spool member having a passage adapted to cooperate with said body passageway so as to selectively uncover a metering port therebetween, the orifice area of said metering port being a function of the angular position of said spool member relative to said body, and wherein the direction of fluid flow is inward from said one passageway to said spool member passage, the improvement which comprises:

said body passageway being so configured and arranged so as to cause the inward flow through said metering port to be substantially radial such that the application of tangential reaction forces attributable to said inward flow to said spool member is substantially eliminated, and wherein a wall of the passageway located upstream of said orifice terminates in an edge of said metering port which is arranged in a plane containing the axis of said spool and said wall is relieved from said plane by an angle of at least 21° such that the flow through said metering port is substantially radial.

6. The improvement as set forth in claim 2 wherein said body includes a sleeve member surrounding said spool member and extending said body passage to cooperate with said spool passageway.

7. The improvement as set forth in claim 5 wherein said body passageway is substantially rectangular at the intersection of said bore.

8. The improvement as set forth in claim 5 wherein said spool member passage is substantially rectangular in the vicinity of said bore.

9. In a rotary valve adapted to be associated with a fluid source and a fluid return, and adapted to control the flows of fluid through variable-area metering ports with respect to the opposed chambers of a fluid-powered load, said valve having a body provided with an elongated bore, said body having two passageways communicating with said bore at spaced locations therealong, said valve also having an elongated spool member rotatably mounted in said bore, said spool member having two passages each adapted to cooperate with a respective one of said body passageway so as to selectively uncover two metering ports therebetween, the orifice areas of said metering ports being a function of the angular position of said spool member relative to said body, and wherein the direction of fluid flow is inward through one metering port and outward through the other metering port, the improvement which comprises:

said body passageways and said spool passages being so configured and arranged that the application of tangential reaction forces attributable to the flows through each of said metering ports to said spool member is substantially eliminated, and wherein a wall of each passageway or passage located upstream of an associated orifice terminates in an edge of said metering port which is arranged in a plane containing the axis of said spool and said wall is relieved from said plan by an angle of at least 21° such that the flow through said metering port is substantially radial.

10. The improvement as set forth in claim 9 wherein said body includes a sleeve member surrounding said spool member and extending said body passage to cooperate with said spool passageway.

11. The improvement as set forth in claim 9 wherein said body passageway is substantially rectangular at the intersection of said bore.

12. The improvement as set forth in claim 9 wherein said spool member passage is substantially rectangular in the vicinity of said bore.

* * * * *